United States Patent [19]

Bardenhagen et al.

[11] 4,406,197

[45] Sep. 27, 1983

[54] METHOD AND APPARATUS FOR TRANSPORTING ROD-SHAPED ARTICLES

[75] Inventors: Dietrich Bardenhagen, Hamburg; Nikolaus Häusler, Oststeinbek; Helmut Niemann, Hamburg; Heinz Greve, Hamburg; Karl-Heinz Schlüter, Hamburg, all of Fed. Rep. of Germany

[73] Assignee: Hauni-Werke Körber & Co. KG, Hamburg, Fed. Rep. of Germany

[21] Appl. No.: 267,921

[22] Filed: May 28, 1981

[30] Foreign Application Priority Data

Aug. 16, 1980 [DE] Fed. Rep. of Germany ..... 3030949

[51] Int. Cl.[3] ..... B26D 7/06; A24C 5/28

[52] U.S. Cl. ..... 83/152; 83/99; 83/100; 83/154; 83/158; 83/161; 198/478

[58] Field of Search ..... 83/152, 23, 154, 158, 83/161, 99, 100; 198/478, 433

[56] References Cited

U.S. PATENT DOCUMENTS

| | | | |
|---|---|---|---|
| 1,626,707 | 5/1927 | Soubier | 198/478 X |
| 1,775,381 | 9/1930 | Angus | 198/478 |
| 1,791,427 | 2/1931 | Regenstreif | 198/433 X |
| 3,567,011 | 3/1971 | Pinkham | 198/478 |
| 3,625,103 | 12/1971 | Giatti | 83/154 X |
| 3,776,343 | 12/1973 | Gouy | 198/478 |
| 3,957,152 | 5/1976 | Heitmann | 198/480 |
| 4,051,947 | 10/1977 | Schumacher et al. | 198/478 |

*Primary Examiner*—Frank T. Yost

*Attorney, Agent, or Firm*—Kontler, Grimes & Battersby

[57] ABSTRACT

A filter rod making machine discharges several parallel filter rods which move lengthwise and are severed at regular intervals to yield files of axially aligned filter rod sections. Such sections are transported axially to a first transfer station where they enter discrete flutes in the concave upper side of one of several rotary platforms which orbit about the axis of a rotary carrier and are rotated relative to the carrier by crank drives so that the orientation of their flutes remains unchanged. The flutes of a platform which arrives at the first station receive discrete filter rod sections from each of the files so that each platform accumulates a group of parallel sections which are transported to a second station for transfer into successive peripheral flutes of a rotary drum-shaped removing conveyor. The second station is located at a level above the first station and the position of the drum-shaped conveyor with reference to the flutes arriving at the second station is such that successive sections which leave the flutes of a platform moving past the second station are aspirated into successive flutes of the removing conveyor by moving sideways, the same as with the flutes of the removing conveyor. The carrier for the platforms rotates about an axis which is inclined to the vertical, and the flutes of the platforms are located in horizontal planes, the same as the filter rod sections which arrive at the first station.

24 Claims, 3 Drawing Figures

METHOD AND APPARATUS FOR TRANSPORTING ROD-SHAPED ARTICLES

BACKGROUND OF THE INVENTION

The present invention relates to a method and apparatus for transporting rod-shaped articles, especially rod-shaped articles which constitute or form part of smokers' products. Such articles include, filter rod sections as well as plain or filter cigarettes, cigars, cigarillos or cheroots.

It is often necessary to change the orientation or grouping of rod-shaped articles, such as filter rod sections, on their way from a making machine to a processing machine or from a preceding to a next-following processing machine. For example, a conventional filter rod making machine turns out a continuous filter rod, e.g., a filter rod wherein a filler of fibrous filter material is confined in a tubular envelope consisting of cigarette paper, imitation cork or the like. The rod is severed at regular intervals to yield a file of filter rod sections of desired length (e.g., six or eight times unit length), and such sections are thereupon transported to the magazine of a filter tipping machine wherein the filter rod sections are converted into filter plugs of unit length or double unit length and are assembled with plain cigarettes to form therewith filter cigarettes of unit length or double unit length. During transport from the filter rod making to the filter tipping machine, the filter rod sections are normally caused to change the direction of their movement from axial or lengthwise movement to transverse or sidewise movement.

Numerous apparatus are known and used to change the orientation and grouping of cigarettes, filter rod sections or analogous rod-shaped articles. For example, a cigarette maker is normally equipped with an accelerating cam which is located downstream of a so-called cutoff serving to subdivide a continuous cigarette rod into a file of discrete plain cigarettes of unit length. The cam has one or more lobes which propel successive plain cigarettes of the file into the axially parallel peripheral flutes of a rotary drum-shaped row forming conveyor so that the file is converted into one or more rows wherein the cigarettes move sideways. Such cigarettes are ready for delivery to a filter tipping machine, i.e., for assembly with filter plugs and uniting bands to form filter cigarettes of unit length or multiple unit length. The situation is analogous when a continuous filter rod is subdivided into a single fine or filter rod sections of desired length and the file is thereupon converted into one or more rows wherein the sections move sideways. It is also known to propel filter rod sections through pneumatic conveyor systems from the maker or makers to one or more remote reservoir systems or processing machines. The just outlined conventional apparatus operate quite satisfactorily when a single file of cigarettes, filter rod sections or analogous rod-shaped articles is to be converted into one or more rows or other formations. However, such conventional apparatus are incapable of handling large or extremely large quantities of rod-shaped articles, for example, all of the articles which are supplied or can be supplied by a filter rod making machine having several extruders each of which forms and discharges a discrete filter rod which is subdivided into filter rod sections of desired length. All heretofore known apparatus are specifically designed for the treatment or processing of a single file or row of rod-shaped articles and their multiplication (e.g., eightfold multiplication, in order to be capable of processing the output of a machine which turns out a substantial number of continuous filter rods or the like) would entail a disproportionate increase in the bulk, cost and complexity of such apparatus.

OBJECTS AND SUMMARY OF THE INVENTION

An object of the invention is to provide a novel and improved method of manipulating large quantities of rod-shaped articles, especially during transfer of such articles from a maker to one or more processing machines.

Another object of the invention is to provide a method which can be resorted to for reliable, accurate and reproducible processing of large quantities of rod-shaped articles which constitute or form part of smokers' products, especially for the processing of filter rod sections which are obtained by simultaneous subdivision of several continuous filter rods into discrete sections or articles of desired length.

A further object of the invention is to provide a novel and improved method of converting several continuous rod-like bodies into a single row of rod-like articles.

An additional object of the invention is to provide a novel and improved method of changing the formation of large quantities of rod-shaped articles in a small area, without any damage to the articles, and in a highly predictable way so that the final formation or array of articles is best suited for further processing, such as packing, storing, assembling, inspecting, stacking and/or others.

A further object of the invention is to provide a novel and improved apparatus for the practice of the above outlined method.

An additional object of the invention is to provide a novel and improved apparatus for processing the output of a filter rod making machine which simultaneously furnishes a large number of continuous filter rods.

Another object of the invention is to provide the apparatus with novel and improved means for changing the formation of large or extremely large numbers of discrete rod-shaped articles per unit of time, in a small area, without any damage to the articles and with a heretofore unmatched degree of accuracy.

An ancillary object of the invention is to provide novel and improved conveyor means for use in an apparatus of the above outlined character.

An additional object of the invention is to provide an apparatus which can be readily combined with or integrated into existing machines for the production and/or processing of filter rod sections, cigarettes or analogous rod-shaped articles constituting or forming part of smokers' products.

Another object of the invention is to provide the apparatus with novel and improved means for avoiding interference between successively treated rod-shaped articles.

A further object of the invention is to provide the apparatus with novel and improved means for carrying rod-shaped articles during conversion from axial to sidewise movement, or vice versa.

Another object of the invention is to provide the apparatus with novel and improved means for preventing centrifugal force from interfering with orderly transfer of large numbers of rod-shaped articles from several paths wherein the articles move axially to a single path wherein the articles move sideways, or vice versa.

An additional object of the invention is to provide an apparatus which, though especially suited to accept and manipulate the output of a filter rod making machine of the type capable of turning out several filter rods at a time, can be used with equal or practically equal advantage for the processing of plain or filter cigarettes or other tabacco-containing rod-shaped articles.

Another object of the invention is to provide novel and improved means for synchronizing the movements of various component parts of the improved apparatus.

An additional object of the invention is to provide a filter rod making or other continuous rod making machine with novel and improved means for forming and guiding several files of discrete rod-shaped articles into the range of the mechanism which is designed to change the direction of movement of such articles.

One feature of the invention resides in the provision of a method of transporting rod-shaped articles which constitute or form part of smokers' products from a first station to and beyond a second station. The method comprises the steps of feeding or supplying articles lengthwise to the first station along at least one first path (for example, the just mentioned step may comprise feeding several files of parallel articles along an equal number of discrete first paths toward and to the first station), repeatedly removing groups of articles from the first station and transferring successively removed groups of articles from the first to the second station (the removing step preferably includes simultaneously engaging and removing all articles of a group while the articles of the group are parallel or substantially parallel to each other), individually delivering the articles of a group at the second station into at least one second path, and moving the individually transferred articles sideways along the second path. Thus, the improved method involves maintaining at the first station sufficient numbers of articles to allow for simultaneous removal of an entire group of (for example, eight) articles at a time, simultaneous transfer of the articles of an entire group from the first to the second station, and individual delivery of successive articles of a group at the second station into the second path or paths, e.g., into the axially parallel peripheral flutes of a rotary drum-shaped removing conveyor.

The delivering step preferably comprises moving the articles of a group at the second station from the second station into the second path or paths by moving the articles sideways or substantially sideways.

The feeding or supplying step preferably comprises supplying successive groups of articles to the first station by moving the articles axially (lengthwise) and in parallelism with one another. In other words, the groups can but need not be formed at the first station; such groups can be formed in or at the discharge end of the machine which produces rod-shaped articles, for example, a machine which extrudes several continuous filter rods and is equipped with means for severing the rods at desired intervals so that each rod yields a file of discrete rod-shaped articles. Each article of a file preferably constitutes one component of a different group, and each group preferably includes one article of each of the plurality of files. At the present time, it is preferred to accumulate, transfer and break up groups each of which contains the same number of rod-shaped articles.

It is advisable to resort to a transferring step which involves moving successive groups of articles from a first level at the first station to a second level at the second station, for example, from a lower first level to a higher second level. This renders it possible to avoid collisions between neighboring articles of successive groups even if such groups are transported in immediate or close proximity to each other. The arrangement is preferably such that, during transfer from the first to the second station, each article of a group has a component of movement in the axial direction as well as a component of movement transversely of the axial direction. If the method is resorted to for conversion of several files of discrete articles into a single row of such articles, the axial component of movement decreases and the other component of movement increases during transfer of a group from the first to the second station.

It is further preferred, at least in certain instances, to maintain the articles of the group which is in the process of moving from the first to the second station in at least substantially horizontal positions. The same preferably holds true for the articles which approach the first station and for the articles which are transported away from the second station.

In order to ensure that the method can be resorted to for the processing of large numbers of articles per unit of time, the transporting step preferably includes removing from the first station a next-following group of articles prior to completion of transfer of the preceding group to the second station or prior to completion of delivery of articles of a group at the second station into the second path or paths. In other words, two or more groups can be in motion from the first to the second station as well as at the second station at all times. The articles of all groups which are in the process of moving from the first toward the second station are preferably maintained in substantial or exact parallelism with one another. In other words, if the articles are parallel to each other on arrival at the first station, they remain parallel to each other during transport to the second station regardless of whether the articles form two or more groups all of which are in motion in a direction from the first toward the second station.

The articles may constitute filter rod sections of multiple unit length, e.g., six times unit length.

The method can further comprise the steps of forming successive groups of articles for delivery to the first station (including advancing a plurality of substantially parallel continuous rods lengthwise toward the first station and simultaneously severing all of the rods at predetermined intervals so that each rod yields a file of discrete rod-shaped articles and each article of one file forms one of the groups with an article of each other file), and delivering successive groups of articles to the first station.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
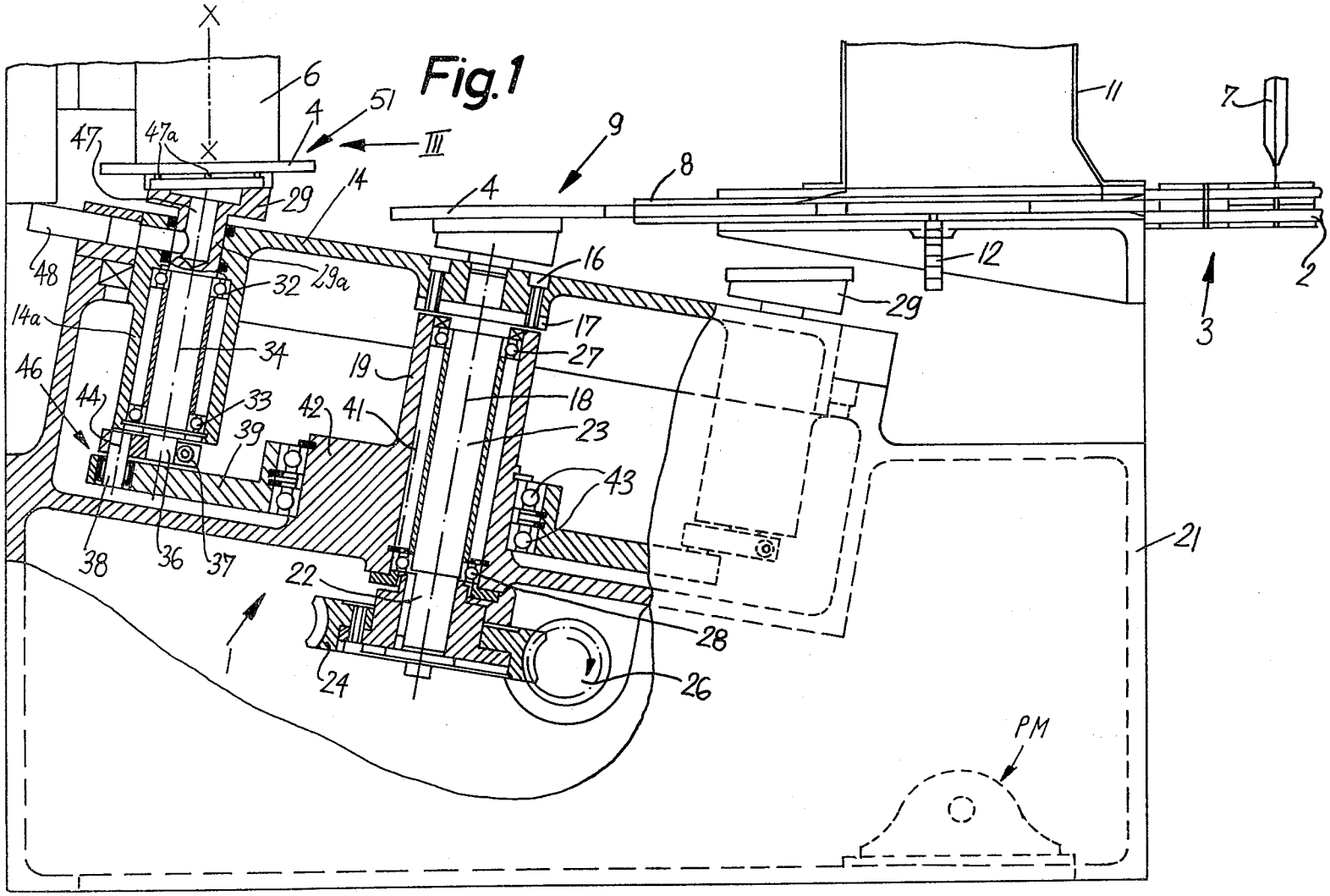
FIG. 1 is a fragmentary elevational view of an apparatus which embodies the invention, the transfer conveyor being shown partly in a central vertical sectional view.

The improved apparatus comprises a transfer conveyor 1 which is installed between a rod forming machine 3 and a removing conveyor 6. The rod forming machine 3 turns out a plurality of continuous filter rods 2 in accordance with a well known extrusion method and further comprises a severing device 7 which subdivides the filter rods 2 into groups 13 of eight rod-shaped articles (filter rod sections) 4 each. The filter rod sections or articles 4 are formed upstream of a battery of parallel tubular or channel-shaped guides 8 which can be said to constitute an article supplying or feeding conveyor at the discharge end of the rod forming machine 3 and sever to deliver successive groups 13 of eight rod-shaped articles 4 each into the range of the transfer conveyor 1. The removing conveyor 6 comprises or constitutes a rotary drum-shaped member with axially parallel peripheral flutes 6*a* (see FIG. 3) for reception of discrete articles 4. The manner in which rod-shaped articles can be transferred into the flutes of a rotary drum-shaped conveyor is disclosed, for example, in commonly owned U.S. Pat. No. 3,957,152 granted May 18, 1976 to Heitmann for "Apparatus for changing the spacing of cigarettes or the like."

A severing device which can simultaneously cut several continuous filter rods is disclosed in the commonly owned copending application Ser. No. 248,012 filed Mar. 26, 1981 by Dietrich Bardenhagen et al. for "Apparatus for simultaneous severing of plural moving parallel rods." For the sake of convenience and completeness, the disclosure of the copending application Ser. No. 248,012 is incorporated herein by reference. As disclosed in the said copending application, the axes of the filter rods 2 are preferably located in an arcuate plane during travel past the severing device 7. The reference character 9 denotes a transfer station where successive groups 13 of filter rod sections (rod-shaped articles) 4 issue from the respective tubular guides 8; at least at this station, the guides 8 are parallel with and immediately or closely adjacent to each other so that the distance between the neighboring articles 4 of a group 13 is negligible or small, i.e., it need not appreciably exceed the wall thickness of a tubular guide 8.

The intake of a suction duct 11 is located immediately above the path of groups 13 of articles 4 on their way toward the transfer station 9. Such intake is located at a level above a battery of ejecting devices 12 in the form of nozzles which can receive streams of pressurized fluid in order to expel selected articles 4 (particularly defective articles) from their respective paths and into the suction duct 11. The manner in which the defects of the articles 4 are ascertained and the detector means transmits signals to valves controlling the admission of a pressurized fluid (e.g., compressed air) into the corresponding nozzles 12 forms no part of the present invention. At least one nozzle 12 is preferably provided for each of the eight guides 8. The nozzles 12 need not eject or segregate only those articles 4 which are defective; for example, such nozzles can also effect expulsion of articles 4 after the machine 3 is started if the design of this machine is such that it is likely to produce defective articles immediately after starting. Alternatively, or in addition to their heretofore described functions, the nozzles 12 can serve to expel articles during each change in speed of the main prime mover PM of the machine 3.

The output of the machine 3 is assumed to be very high so that the guides 8 discharge groups 13 of eight articles 4 each at a high frequency. This renders it necessary to utilize the improved apparatus, i.e., an apparatus including the combination of the machine 3 (or more particularly, of the article supplying or feeding conveyor of this machine) with the novel transfer conveyor 1 and the removing or take-off conveyor 6.

As can be seen in FIG. 1, the transfer conveyor 1 comprises a first rotary carrier 14 which can be said to resemble or constitute a turntable the underside of which is connected with a flange 17 at the upper end of an elongated shaft 23. The axis of the shaft 23 is shown at 18; its flange 17 is separably secured to the underside of the carrier or turntable 14 by screws 16 or analogous fastener means. The shaft 23 is rotatable in a cylindrical or sleeve-like bearing member 19 (hereinafter called sleeve) and is journalled in several antifriction bearings including those shown at 27 and 28 constituting ball or roller bearings of any known design. The sleeve 19 is mounted on or is integral with a frame member 21 of the apparatus including the machine 3, the transfer conveyor 1 and the removing conveyor 6. The axis 18 of the shaft 23 is inclined to the vertical so that the upper side of the turntable 14 is inclined with reference to a horizontal plane. The angle between a horizontal plane and the upper side of the turntable 14 is a relatively small acute angle. The paths of the filter rods 2 are horizontal or substantially horizontal, i.e., such paths are also inclined with reference to the upper side of the turntable 14. The same holds true for the orientation of the upper side of the turntable 14 with reference to the preferably horizontal paths which are defined by the guides 8 for the groups 13 of articles 4.

The lower end portion of the shaft 23 extends from the sleeve 19 and constitutes a smaller-diameter stub 22 which is rigidly connected with a pinion 24 mating with a worm wheel 26 receiving torque from the main prime mover PM of the machine 3. Thus, the turntable 14 is driven at an RPM which is proportional to the RPM of rotary components of the machine 3. The prime mover PM preferably further transmits torque to the removing conveyor 6 so that the latter is driven in synchronism with the transfer conveyor 1 and also in synchronism with the means for forming and advancing the filter rods 2 toward the severing device 7 of the machine 3.

Figure 3:
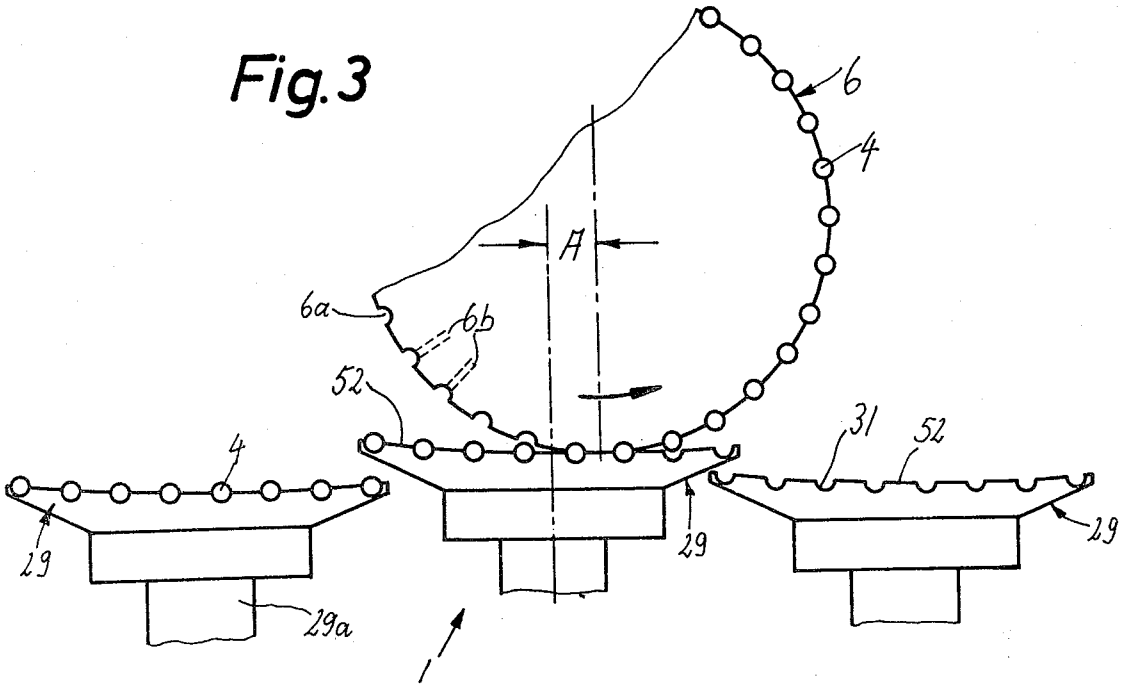
FIG. 3 is a view as seen in the direction of arrow III in FIG. 1, showing a portion of the removing conveyor and three platforms of the transfer conveyor.

The transfer conveyor 1 further comprises eight identical equiangular article transferring units in the form of rotary platforms 29. The axes of rotation of the eight platforms 29 are equidistant from the axis 18 of the shaft 23. As can be seen in FIG. 3, the upper side of each platform 29 is formed with eight equidistant parallel elongated article receiving flutes 31 so that each platform 29 can accept and transport an entire group 13 of eight parallel articles 4 during travel past the station 9 at the discharge ends of the guides 8. The flutes 31 of the platforms 29 are horizontal, i.e., they make acute angles with the upper side of the turntable 14. When the prime mover PM is on to drive the shaft 23 through the medium of the transmission including the worm wheel 26 and pinon 24, the platforms 29 orbit about the axis 18 and are caused to maintain their flutes 31 in horizontal planes, i.e., in planes which are parallel to the paths of the filter rods 2 and articles 4.

Owing to the aforementioned inclination of the upper side of the turntable 14 with reference to a horizontal plane, the projection of the path of orbital movement of platforms 29 about the axis 18 into a horizontal plane X—X is an ellipse. The major axis of this ellipse is normal to the plane of FIG. 1, i.e., such major axis extends vertically, as viewed in FIG. 2. As shown in FIG. 3, the upper sides or surfaces 52 of the platforms 29 (i.e., those sides which are formed with eight parallel article receiving flutes 31 each) are concave and the curvature of such concave upper sides conforms to the curvature of the elliptical path portion at a second transfer station 51. This allows for proper transfer of articles 4 from successive flutes 31 of a platform 29 into successive flutes 6*a* of the removing conveyor 6.

Figure 2:
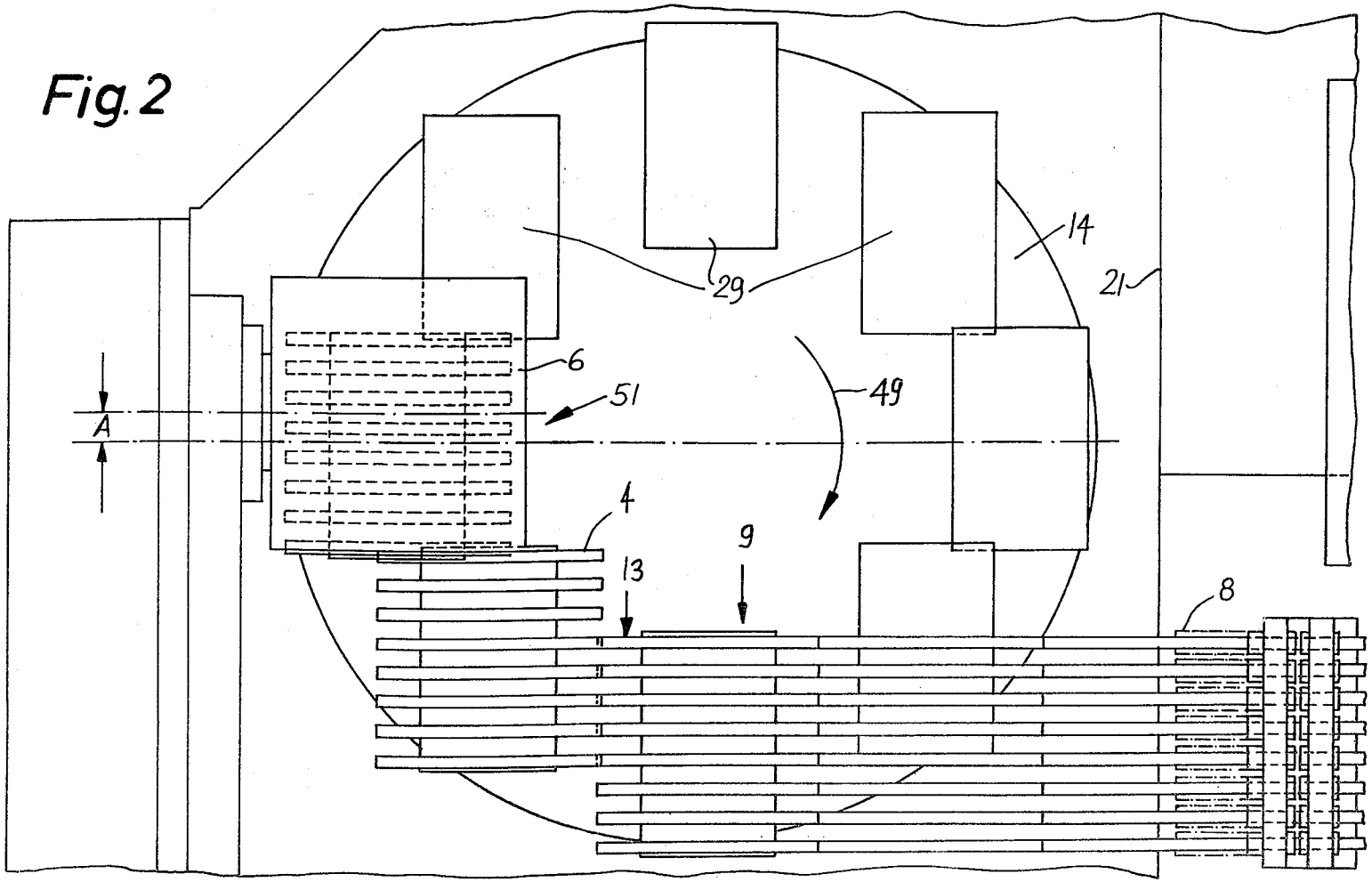
FIG. 2 is a plan view of the structure which is shown in FIG. 1.

The vertical plane which includes the horizontal axis of rotation of the removing conveyor 6 is offset with reference to the vertical plane including the axis 18 by a distance A (indicated in FIGS. 2 and 3). The curvature of the upper sides 52 of platforms 29 is asymmetric to an extent corresponding to the distance A. Otherwise stated, the lowermost point of the upper side 52 of a given platform 29 is offset with reference to the center of such platform by the distance A. This can be readily seen in FIG. 3.

The platforms 29 have downwardly extending shanks 29*a* which are rotatably mounted in antifriction bearings 32 and 33 provided therefor in suitable sockets or bearing sleeves 14*a* at the underside of the turntable 14. The axes 34 of rotation of the shanks 29*a* are parallel to the axis 18 of the shaft 23. The lower end portion 36 of each shank 29*a* constitutes a smaller-diameter stub which is connected to a discrete shaft 38 by a lever 37 (see the left-hand portion of FIG. 1). The shafts 38 are mounted in a second carrier 39 which is rotatable about an axis 41; the latter is parallel to the axis 18, i.e., the two carriers 14 and 39 can rotate relative to and are eccentric with reference to each other. As shown in FIG. 1, such mounting of the carrier 39 with reference to the carrier or turntable 14 can be readily achieved by resorting to a bearing block 42 whose axis of rotation coincides with the axis 41, which is eccentric to and rotatable around the shaft 23 of the turntable 14, and which is surrounded by antifriction ball bearings 43 for the carrier 39. The bearing block 42 can form an integral part of the sleeve 19 for the shaft 23.

Each lever 37 constitutes with the corresponding stub 36 and shaft 38 a crank drive 46 which rotates the corresponding platform 29 relative to the turntable 14 while the turntable rotates about the axis 18 and the corresponding platform 29 rotates about its axis 34. This ensures that the flutes 31 of each platform 29 remain parallel with the guides 8 in each angular position of each platform 29 with reference to the axis 18 of the turntable 14. In other words, while the pinion 24 rotates the turntable 14 about the axis 18, the carrier 39 causes the cranks 46 to rotate the corresponding platforms 29 about the respective axes 34 so that the orientation of the flutes 31 remains unchanged, i.e., the flutes 31 remain parallel to the flutes 6*a* of the removing conveyor 6 as well as to the guides 8.

The flutes 31 of the platforms 29 communicate with suction ports 47*a* which, in turn, communicate with the associated suction channels or bores 47 in the respective shanks 29*a*. Each channel or bore 47 communicates with a main suction line 48 whose outlet is connected with the intake of a fan or another suitable suction generating device, not shown. The arrangement is such that the suction ports 47*a* communicate with the main suction line 48 during travel of the respective flutes 31 from the transfer station 9 to the second transfer station 51 where the articles 4 are transferred from the flutes 31 into the flutes 6*a*. The manner in which the suction ports 47*a* can communicate with the main suction line 48 in certain angular positions of the respective platforms 29 is well known in many fields, for example, in the field of transporting plain cigarettes or filter tipped cigarettes. Reference may be had, for example, to commonly owned U.S. Pat. No. 3,952,865 granted Apr. 27, 1976 to Willy Rudszinat for "Transfer apparatus for cigarettes or the like." The disclosure of the patent to Rudszinat is incorporated herein by reference. All that counts is to ensure that a flute 31 can receive and retain an article 4 during travel past the transfer station 9 and retains such article by suction during travel toward the transfer station 51 as well as at the transfer station 51 until it registers with an oncoming flute 6*a* which latter then accepts the article 4 therefrom. The manner in which the flutes 6*a* can be connected with a suction generating device during travel past the station 51 and thence to the station where the articles 4 are taken off the removing conveyor 6 forms no part of the present invention. Reference may be had to commonly owned U.S. Pat. No. 3,520,177 granted July 14, 1970 to Heitmann et al. for "Apparatus for testing and classifying cigarettes or the like"; this patent shows a rotary drum-shaped testing conveyor which is provided with means for holding by suction rod-shaped articles during transport from a first station where the flutes of the testing conveyor receive rod-shaped articles from a preceding conveyor and on to a station where the flutes of the testing conveyor are relieved of freshly tested rod-shaped articles. There are eight main suction lines 48, one for each of the platforms 29, and these main suction lines are provided in the frame member 21 or in the portion (sleeve) 19 of this frame member. As a rule, the suction lines 48 communicate with grooves or slots which extend along portions of the peripheries of shanks 29*a* so that the channels 47 communicate with the respective suction lines 48 in certain angular positions of the respective platforms 29, namely, in those angular positions which the platforms 29 assume while their flutes 31 must hold rod-shaped articles 4 during transport from the station 9 to the station 51.

FIG. 2 shows that the turntable 14 can support a substantial number of platforms 29 (eight platforms are actually shown). This means that, if the dimensions of the turntable 14 are not overly large, the platforms 29 are rather closely adjacent to each other. Furthermore, and in order to reduce the energy requirements of the prime mover PM which must rotate the turntable 14, it is advisable to employ relatively small platforms 29 so as to reduce the mass and bulk of the transfer conveyor 1. Therefore, the flutes 31 can be shorter than the articles 4, i.e., each article 4 will extend beyond at least one but normally beyond both ends of the respective flute 31. This increases the danger or likelihood of interference of articles 4 in the flutes 31 of a preceding platform 29 with the articles 4 in the flutes 31 of the next-following platform 29. Such danger or likelihood is effectively prevented by causing the filled platforms 29 to move from the lower level of the transfer station 9 to the higher level of the transfer station 51. Mounting of the platforms 29 (in the illustrated embodiment, each platform 29 has a rectangular outline and the flutes 31 are parallel with the shorter sides of the respective platform) close to each other renders it possible to transport several complete groups 13 at a time, i.e., at least one next-following platform 29 is filled with articles 4 and advances from the transfer station 9 toward the transfer station 51 before the preceding platform 29 is relieved of articles during transport past the station 51. FIG. 2 shows a preceding platform 29 (at the nine o'clock position of the turntable 14) which is in the process of being relieved of articles 4, one after the other; a next-following platform 29 located at the seven and a half o'clock position of the turntable 14 and filled with a group 13 of eight articles 4; and a third platform 29 which is located at the six o'clock position of the turntable 14 and also carries a full group of articles 4. All of the articles 4 at the transfer stations 9, 51 as well as in that arcuate portion of the endless path of platforms 29 which extends between the stations 9 and 51 are parallel to one another. The same holds true for the articles 4 which are already held in the flutes 6*a* of the conveyor 6. Furthermore, and as mentioned above, the illustrated apparatus is designed in such a way that the articles 4 are horizontal during travel toward the transfer station 9, during travel between the transfer stations 9, 51 as well as during travel beyond the transfer station 51. This, too, contributes to a reduction of the likelihood of clashing between the neighboring ends of articles 4 in groups 13 which are supported by successive platforms 29. This can be readily seen in FIG. 3 wherein the median platform 29 is at the transfer station 51, the loaded left-hand platform 29 is in the process of advancing toward the transfer station 51, and the empty right-hand platform 29 is on its way from the transfer station 51 back toward the transfer station 9. The difference between the level of the median platform 29 and the two outer platforms 29 of FIG. 3 is sufficiently pronounced to allow for unimpeded transfer of successive articles 4 from the flutes 31 of the median platform 29 into successive flutes 6*a* of the removing conveyor 6. Retention of articles 4 in positions of parallelism with one another during transport from the transfer station 9 toward the transfer station 51 reduces the likelihood of expulsion of articles from their respective flutes 31 under the action of centrifugal force. The effect of centrifugal force can be quite pronounced, especially when the machine 3 turns out the filter rods 2 at a very high speed, i.e., when the severing device 7 forms a large number of articles 4 (and more particularly a large number of groups 13 of articles 4) per unit of time so that the turntable 14 must be rotated at a high speed. Each article 4 which advances from the transfer station 9 toward the transfer station 51 has a component of movement in the axial direction thereof as well as a component of movement transversely of its axis. The axial component decreases as the article approaches the transfer station 51, and the transverse component increases accordingly. At the transfer station 51, the articles move only sideways or practically exclusively sideways.

The eight platforms 29 which are shown in FIG. 2 are equiangular and their axes of rotation are disposed at the same distance from the center of the turntable 14, i.e., the radial distance between the axis 18 and all of the axes 34 is the same. Since the path along which the guides 8 deliver groups 13 of articles 4 to the transfer station 9 is horizontal or nearly horizontal, the upper sides or surfaces 52 of the platforms 29 (save for the aforediscussed asymmetric concavity of such surfaces) are also substantially horizontal. Furthermore, the flutes 31 of the platforms 29 are horizontal in spite of the concavity of upper sides or surfaces 52 (see FIG. 3 wherein the axes of articles 4 in the flutes 31 of the median and left-hand platforms 29 are horizontal). The flutes 31 of each platform 29 are parallel to each other, and the flutes 31 of all platform 29 are also parallel to one another as well as to the paths which are defined by the guides 8 and also to the flutes 6*a* of the removing conveyor 6. The inclination of the axis 18 relative to the plane of the paths defined by the guides 8 is selected with a view to prevent interference between the articles 4 in the flutes 31 of neighboring platforms 29 while such platforms advance past the transfer station 9, toward the transfer station 51, and past the transfer station 51. The path of the platforms 29 is a circular path; however, and as mentioned above, its projection into the plane X—X shown in FIG. 1 (as viewed in the direction of the arrow III) is an ellipse owing to inclination of the axis 18 to the vertical and also owing to the fact that the flutes 31 and tubular guides 8 are horizontal. The plane X—X is normal to the axis of rotation of the drum-shaped removing conveyor 6. The asymmetric curvature of the upper sides or surfaces 52 of the platform 29 is advantageous owing to elliptic configuration of the aforediscussed projection of circular path of the platforms 29 into the plane X—X. In the absence of such asymmetry, the distance between successive flutes 31 and the oncoming flutes 6*a* at the transfer station 51 would vary from one side toward the other side of the respective platform 29. This would mean that, if the articles 4 are removed from the flutes 31 by suction, the removing conveyor 6 would have to cooperate with a very large suction generating device in order to invariably ensure reliable lifting of successive articles 4 of a group 13 from the flutes 31 of a platform 29 moving past the transfer station 51 into successive flutes 6*a* of the conveyor 6. In an ideal situation, namely, when the curvature of the surfaces 52 matches the curvature of the elliptical projection of circular path of the platforms 29 into the plane X—X of FIG. 1 at the station 51, the distance between each of a series of eight flutes 31 in the surface 52 and the series of eight flutes 6*a* in the periphery of the removing conveyor 6 is the same, i.e., each and every article 4 of a group 13 covers the same distance during transfer from the platform 29 at the station 51 into the flutes 6*a* of the removing conveyor 6.

Staggering of the central vertical plane of the removing conveyor 6 (namely of a plane which includes the axis of the conveyor 6) with reference to the vertical plane including the axis 18 by the aforediscussed distance A further reduces the likelihood of clashing between the articles 4 on neighboring platforms 29 during transport toward and during movement of such platforms past the transfer station 51. Moreover, such staggering of the two vertical planes contributes to possibility of transferring successive articles 4 of a group 13 at identical intervals. The two vertical planes are staggered with reference to each other by the distance A in a direction at right angles to the longitudinal extensions of the articles 4 which approach the transfer station 9, which move from the transfer station 9 toward the transfer station 51, and which leave the transfer station 51 on the conveyor 6. The elimination or reduction of the effect of centrifugal force upon the articles 4 which move from the transfer station 9 toward and past the transfer station 51 is guaranteed by rotating the platforms 29 about the respective axes 34 so that the flutes 31 remain parallel to the guides 8 in all angular positions of the platforms 29 during movement of platforms along their circular path which surrounds the axis 18 of the turntable 14. An excessive centrifugal force could lead to deformation of and/or other damage to the articles 4 even if the centrifugal force does not suffice to actually expel the articles from their flutes 31 ahead of the transfer station 51.

The aforediscussed crank drives 46 constitute but one form of means for rotating the platforms 29 relative to the turntable 14 while the latter rotates about the axis 18. For example, one could resort to planetary gearings which are customery in transfer apparatus for conversion of a single file of rod-shaped articles into a row. It has been found that the crank drives 46 constitute a very simple and effective means for rotating the platforms 29 relative to the turntable 14. The platforms 29 are rotated at the RPM of the turntable 14 but in the opposite direction. Thus, and referring to FIG. 2, the turntable 14 is driven by the pinion 24 to rotate clockwise (arrow 49) whereas the crank drives 46 rotate the respective platforms 29 in a counterclockwise direction while the platforms orbit about the axis of the turntable 14. The crank drives 46 can be said to constitute a means for transmitting torque from one (39) of the carriers (14, 39) to the other of these carriers. A further advantage of the crank drives 46 is that they generate a minimum of noise, that the wear upon their component parts is negligible, that they can rotate the platforms 29 with a high degree of accuracy and reliability for long periods of time, and that they occupy a small amount of space in the interior of the turntable 14 or in the space below the turntable. Each crank drive 46 is rotatably mounted in or on the turntable 14 and is rigidly connected with the respective platform 29. The distance between the two axes of rotation of each crank drive 46 (i.e., the distance between the axis 34 and the axis of the shaft 38 shown in the left-hand portion of FIG. 1) preferably equals or closely approximates the distance between the axes 18 and 41 of the two carriers (turntable 14 and member 39).

The operation:

The prime mover PM drives the turntable 14 through the medium of the worm wheel 26, pinion 24 and shaft 23 at a step-down ratio so that the peripheral speed of the platforms 29 matches the speed of lengthwise movement of filter rods 2 and filter rod sections or articles 4 toward the transfer station 9. The platforms 29 are rotated by the turntable 14 through the medium of the respective crank drives 46 which rotate the carrier 39. Each crank drive 46 performs a predetermined movement during each revolution of the turntable 14 and carrier 39 so as to maintain the flutes 31 of all platforms 29 in the orientations shown in FIG. 2, i.e., in parallelism with the rod-shaped articles 4 which advance through the respective guides 8 and toward the transfer station 9. During each revolution of the turntable 14, each of the platforms 29 moves through all of the positions shown in FIG. 2 whereby successive platforms 29 move from a higher level to a lower level during movement from the nine o'clock toward the three o'clock position and from a lower level to a higher level during movement from the three o'clock and back toward the nine o'clock position, as viewed in FIG. 2. This will be even more readily seen in FIG. 1 which shows that the median platform 29 shown therein is located at a level immediately below the path of articles 4 at the transfer station 9, that the rightmost platform 29 is located well below such level (i.e., well below the guides 8), and that the left-hand platform 29 is located well above such level, i.e., immediately below the path of flutes **6*a* on the removing conveyor 6 whose lowermost point is located at a level above the path for the articles 4 at the transfer station 9. In other words, the transfer station 51 is located at a level above the transfer station 9, the platforms 29 which approach the transfer station 9 move upwardly (see the arrow 49 in FIG. 2), the platforms 29 with freshly filled flutes 31 move upwardly, and the platforms 29 with freshly emptied flutes 31 move downwardly along an arc of 180 degrees and thereupon upwardly along an arc of 90 degrees in order to return to the transfer station 9. Otherwise stated, and referring to FIGS. 1 and 2, the platforms 29 which are located to the left of the transfer station 9 are disposed at a level above the path for the articles 4 toward the station 9, and the platforms 29 to the right of the station 9 are located at a level below such path. This is due to the aforediscussed inclination of the axis 18 of the shaft 23 for the turntable 14**.

The articles 4 of a group 13 which reaches the transfer station 9 are substantially tangential to the path of the corresponding flutes 31 of an oncoming platform 29, whereby such articles enter the respective flutes 31 and advance with the platform 29 toward the transfer station 51. As mentioned above, the speed of movement of platforms 29 along their path about the axis 18 of the turntable 14 matches the speed of lengthwise movement of articles 4 toward and at the transfer station 9. This renders it possible to simultaneously remove an entire group 13 of discrete articles 4 and to thereupon transport such group toward the transfer station 51 without any or without appreciable changes in orientation of the articles 4 which advance from the six o'clock toward the nine o'clock position of FIG. 2. The speed of lengthwise movement of articles 4 which issue from the guides 8 is quite pronounced, i.e., the platforms 29 orbit at a substantial speed in order to ensure adequate processing of all groups 13 while the machine 3 turns out rod-shaped articles 4 at a maximum rate.

As explained above, the suction ports **47*a* of a platform 29 which advances from the transfer station 9 toward the transfer station 51 are connected with the intake of the suction generating device so that the articles 4 which arrive at the station 9 are attracted into the corresponding flutes 31 of the oncoming empty platform 29 and are held against any movement relative to such platform while the latter advances toward the transfer station 51. At the transfer station 51, the suction ports 47*a* of the freshly arrived platform 29 are sealed from the suction generating device so that suction in the ports 6*b* communicating with the flutes 6*a* arriving at the station 51 is effective to ensure reliable transfer of successive articles 4 of a group 13 into successive flutes 6*a* of the removing conveyor 6**.

It will be noted that the articles 4 move lengthwise or axially during transport toward the first transfer station 9, that the articles 4 thereupon move lengthwise as well as sideways (i.e., at right angles to their respective axes) during transport toward and during transfer into the flutes **6*a*, and that the articles 4 in the flutes 6*a* move only sideways, i.e., about the axis of the drum-shaped removing conveyor 6 and on toward a further station where the articles are removed or expelled from the flutes 6*a*** to be transported to the next station, e.g., into the magazine of a filter tipping machine, into a reservoir system or into a machine where they are assembled with other types of filter rod sections to form composite filter plugs of desired length.

Each of the articles 4 which form a group 13 about to be transferred from an oncoming platform 29 into the flutes 6a of the removing conveyor 6 has the same interval of time for reliable and predictable transfer from the respective flute 31 into the oncoming flute 6a.

An important advantage of the improved apparatus is that it can process a surprisingly large number of rod-shaped articles 4 per unit of time. Moreover, the articles are treated gently and each article is delivered to the removing conveyor 6 in an optimum position for further transport and/or processing. The capacity of the apparatus can readily conform to the output of the machine 3, even if such machine is designed to turn out more than eight continuous filter rods 2 at a time. Still further, the apparatus is relatively simple, compact and rugged, and it can be readily combined with existing machines which turn out several files of discrete rod-shaped articles.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for transferring rod-shaped articles which constitute or form part of smokers' products from a first station to and beyond a second station, comprising first conveyor means arranged to feed rod-shaped articles lengthwise to the first station; second conveyor means arranged to transport rod-shaped articles sideways and away from the second station; and transfer conveyor means including means for transporting successive groups of articles from the first to the second station and for delivering successive articles of a group at said second station to said second conveyor means, said transporting means comprising rotary carrier means and a plurality of equiangular platforms rotatably mounted on said carrier means, each of said platforms having a plurality of article receiving means sufficient in number to accept a full group of articles at said first station, and means for rotating said carrier means so as to advance said platforms along an endless path extending past said first and second stations.

2. The apparatus of claim 1, wherein said receiving means are elongated flutes.

3. The apparatus of claim 1, wherein said first conveyor means includes means for maintaining the articles approaching said first station in a predetermined plane, said receiving means of each of said platforms being parallel to one another and the receiving means of the platform at said first station being disposed in a second plane which is at least substantially parallel to said predetermined plane.

4. The apparatus of claim 3, wherein said planes are at least substantially horizontal.

5. The apparatus of claim 1, wherein said first conveyor means includes means for feeding successive groups of articles to the first station in a predetermined plane, and further comprising bearing means defining for said carrier means an axis which makes an oblique angle with said plane.

6. The apparatus of claim 1, further comprising bearing means defining for said carrier means an axis which is inclined to the vertical.

7. The apparatus of claim 6, wherein said second station is located at a level above the first station and the inclination of said carrier means is such that successive platforms advancing from the first to the second station move upwardly from the level of the first to the level of the second station.

8. The apparatus of claim 1, wherein said second station is located at a level above said first station and said carrier means is rotatable about a predetermined axis so that said platforms travel along an endless path having a first portion substantially at the level of said first station and a second portion substantially at the level of said second station.

9. The apparatus of claim 1, wherein said platforms have suction ports and said receiving means are flutes communicating with said suction ports, and further comprising means for evacuating air from said flutes by way of the respective suction ports during travel of said flutes from the first to the second station.

10. The apparatus of claim 1, wherein said first conveyor means forms part of a machine for producing a plurality of continuous rods at a time and said machine further comprises means for severing the rods at predetermined intervals so that each rod yields a file of discrete rod-shaped articles.

11. The apparatus of claim 1, wherein said second conveyor means comprises a rotary drum having axially parallel peripheral flutes for reception of discrete articles at said second station.

12. Apparatus for transferring rod-shaped articles which constitute or form part of smokers' products from a first station to and beyond a second station, comprising first conveyor means arranged to feed rod-shaped articles lengthwise to the first station; second conveyor means arranged to transport rod-shaped articles sideways and away from the second station; and transfer conveyor means including means for transporting successive groups of articles from the first to the second station and for delivering successive articles of a group at said second station to said second conveyor means, said transporting means including at least one platform having a plurality of article receiving means arranged to simultaneously accept a group of articles at the first station and to deliver successive articles of a group at the second station to said second conveyor means, said platform having a concave surface and said receiving means constituting parallel flutes provided in said concave surface.

13. The apparatus of claim 12, wherein said concave surface is the upper side of said platform and said flutes are substantially horizontal.

14. The apparatus of claim 12, wherein said second conveyor means is rotatable about a first predetermined axis located in a first vertical plane and said transporting means includes carrier means supporting said platform and rotatable about a second predetermined axis located in a second vertical plane spaced apart from said first vertical plane, as considered at right angles to the orientation of longitudinal axes of articles at said first station.

15. The apparatus of claim 14, wherein said platform is rotatable relative to said carrier means about a third predetermined axis and said concave surface is asymmetric with reference to said third axis.

16. The apparatus of claim 15, wherein the extent of asymmetry of said concave surface with reference to said third axis at least approximates the distance between said planes.

17. Apparatus for transferring rod-shaped articles which constitute or form part of smokers' products from a first station to and beyond a second station, comprising first conveyor means arranged to feed rod-shaped articles lengthwise to the first station; second conveyor means arranged to transport rod-shaped articles sideways and away from the second station; and transfer conveyor means including means for transporting successive groups of articles from the first to the second station and for delivering successive articles of a group at said second station to said second conveyor means, said transporting means including at least one platform having a plurality of article receiving means arranged to simultaneously accept a group of articles at the first station and to deliver successive articles of a group at the second station to said second conveyor means, said transporting means further including carrier means rotatably supporting said platform and means for rotating said carrier means about a first axis, said platform being rotatable relative to said carrier means about a second axis which is at least substantially parallel to said first axis.

18. The apparatus of claim 17, wherein said receiving means constitute flutes which are parallel to one another and to the articles at said first station, and further comprising means for rotating said platform relative to said carrier means so as to prevent changes in orientation of said flutes while said platform orbits about said first axis in response to rotation of said carrier means.

19. The apparatus of claim 18, wherein said first mentioned rotating means includes means for rotating said carrier means in a first direction and said means for rotating said platform includes means for rotating the platform in a second direction counter to said first direction and at the rotational speed of said carrier means.

20. The apparatus of claim 19, wherein said means for rotating said platform relative to said carrier means comprises second carrier means supporting said platform and rotatable about a third axis parallel to said first axis.

21. The apparatus of claim 20, wherein the means for rotating said platform relative to said first named carrier means further comprises a crank drive rotatably mounted in said first mentioned carrier means and rigid with said platform.

22. The apparatus of claim 21, wherein said crank drive defines two axes spaced apart from one another by a distance equal to the distance between said first and third axes.

23. The apparatus of claim 21, wherein said crank drive constitutes the means for rotating one of said carrier means about the respective axis.

24. The apparatus of claim 23, wherein said one carrier means is said second carrier means.

* * * * *